United States Patent [19]

Himmelbauer

[11] Patent Number: 4,547,694

[45] Date of Patent: Oct. 15, 1985

[54] LOW-LOSS CATHODE FOR A TELEVISION CAMERA TUBE

[75] Inventor: Erich E. Himmelbauer, Eindhoven, Netherlands

[73] Assignee: U.S. Philips Corporation, New York, N.Y.

[21] Appl. No.: 441,183

[22] Filed: Nov. 12, 1982

[30] Foreign Application Priority Data

Dec. 31, 1981 [NL] Netherlands ..... 8105921

[51] Int. Cl.[4] ..... H01J 1/28; H01J 29/04; H01J 31/38

[52] U.S. Cl. ..... 313/384; 313/446; 313/346 DC

[58] Field of Search ..... 313/384, 446, 346 DC, 313/281; 315/382

[56] References Cited

U.S. PATENT DOCUMENTS 2,798,180 7/1957 Winter ..... 313/446
2,810,089 10/1957 MacNair ..... 313/446 X
3,831,058 8/1974 Van Roosmalen ..... 315/382
3,986,066 10/1976 Goll ..... 313/281 X
4,215,457 8/1980 Kuiper et al. ..... 29/25.14

FOREIGN PATENT DOCUMENTS 54-50266 4/1979 Japan .
2057750 4/1981 United Kingdom .

OTHER PUBLICATIONS

Broerse, P. H. et al., "An Experimental Light-Weight Colour Television Camera," *Philips Technical Review*, vol. 29, No. 11, pp. 325-335 (1968).

*Primary Examiner*—Palmer C. DeMeo
*Assistant Examiner*—Sandra L. O'Shea
*Attorney, Agent, or Firm*—Marc D. Schechter

[57] ABSTRACT

By providing the cathode, in a diode electron gun in a television camera tube, with an at least 40 μm high collar extending in the direction of the anode, the anode current is considerably reduced.

11 Claims, 7 Drawing Figures

LOW-LOSS CATHODE FOR A TELEVISION CAMERA TUBE

BACKGROUND OF THE INVENTION

The invention relates to a television camera tube comprising, in an evacuated envelope, a diode electron gun for generating an electron beam. The electron gun comprises, an anode, and a focusing lens. The cathode has a cathode having an emissive surface extending substantially perpendicular to the axis. The anode has a central aperture around the axis. The focusing lens focuses the electron beam on a photosensitive target. A potential distribution is formed on the target by projecting an optical image on it. The target provides electrical signals corresponding to the optical image by scanning with the electron beam.

Such a television camera tube is disclosed in U.S. Pat. No. 3,831,058 (Van Roosmalen). The television camera tube described in that patent comprises a diode electron gun in which, during scanning, the current density of the electron beam at any point along the axis between the cathode and the anode is at most three times the current density at the point of intersection of the axis with the cathode. In order to reduce the beam current inertia, it is important to restrict the number of interactions between the electrons of the electron beam.

However, diode electron guns have the disadvantage of producing a considerable anode current. Since the cathode emits over a very large part of the emissive surface, and since the emissive surface of the cathode is in practice must larger than the area of the aperture in the anode, a very large part of the electron beam current in a diode electron gun is intercepted by the anode. The part of the electron beam current which is intercepted by the anode is the anode current. The anode current causes extra power dissipation, in particular when dynamic beam current control is used. Restricting the emissive surface by making the cathode smaller is not attractive because as a result of this the lifetime of the cathode and hence of the camera tube is reduced.

In Netherlands Patent Application No. 8002037 (published as U.K. Patent Application No. 2,057,750), a television camera tube is described having a diode electron gun in which the anode current is restricted. The anode used in this diode electron gun is funnel-shaped, so that the part of the anode which forms the aperture is situated nearer the cathode than the remainder of the anode. This funnel-shaped part has an area which is less than 75% of the emissive surface of the cathode. As a result of this shape, the anode current is reduced.

SUMMARY OF THE INVENTION

It is an object of the invention to provide a television camera tube in which the anode current is even more reduced and hence less power is lost.

In a television camera tube according to the invention, the emissive surface of the cathode is surrounded by a conductive collar. The collar extends at least 40 μum from the edge of the emissive surface in the direction of the anode and is substantially parallel to the axis.

The electric field between the cathode and the anode is distorted by the collar. The collar extends from the edge of the emissive surface in the direction of the anode in such manner that the field strength at the edge of the cathode, and hence the emission at the edge of the cathode, is much smaller than if no collar were used. As a result, a smaller cathode current will produce a given beam current than without the collar. The reduction of the anode current becomes noticeable with a collar height of at least 40 μum.

Such a collar can be obtained in a simple manner when the cathode is a dispenser cathode. The collar can be formed integrally with the holder which envelops the porous emissive body of the dispenser cathode. Such a dispenser cathode is disclosed in U.S. Pat. No. 4,215,457 (Kuiper et al). The collar in such a cathode is obtained by drawing a metal foil further over a die during a drawing process in which the metal foil is drawn around the porous body.

By making the part of the emissive surface adjoining the collar less porous than the remainder of the emissive surface, the anode current can be even further reduced. This reduction in porosity can be carried out by locally squeezing the pores during the drawing process or by means of a high-energy beam with which the pores are sealed.

DESCRIPTION OF THE PREFERRED EMBODIMENTS

Figure 1:
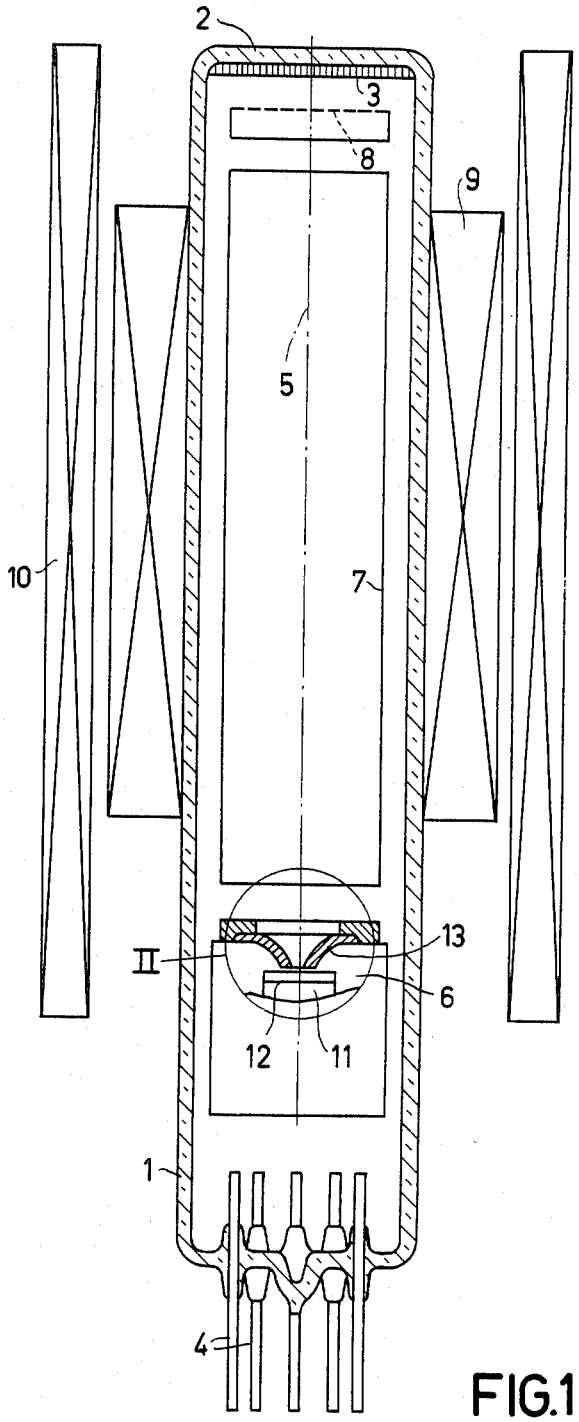
FIG. 1 is a partly schematic, partly longitudinally sectional view of a television camera tube according to the invention, together with deflection and focusing coils.

The camera tube shown in FIG. 1 is of the "Plumbicon" (trademark of N. V. Philips) type. It comprises a glass envelope 1 having at one end a window 2. A photosensitive target 3 is provided on the inside of window 2. This target 3 comprises a photosensitive layer and a transparent conductive signal plate between the photosensitive layer and the window 2. The photosensitive layer consists mainly of activated lead monoxide, and the signal plate consists of conductive tin oxide.

Connection pins 4 of the tube are centered along an axis 5 opposite the window 2. An electron gun 6 is arranged near the pins 4. A collector 7 is arranged between electron gun 6 and target 3.

The tube further comprises a gauze-like electrode 8 which causes the electron beam to land perpendicularly on the target 3. Deflection coils 9 serve to deflect the electron beam generated by the electron gun 6 in two mutually perpendicular directions, in order to write a frame on the target 3. A focusing coil 10 focuses the electron beam on the target 3. The diode electron gun 6 comprises a cathode 11 having an emissive surface 12, and an anode 13. The connection of these parts to one another and the connections to the connection pins 4 are not shown in FIG. 1 to avoid complexity in the drawing. The anode 13 has such a small aperture that not all electrons emitted by cathode 11 will pass through the aperture.

Figure 2:
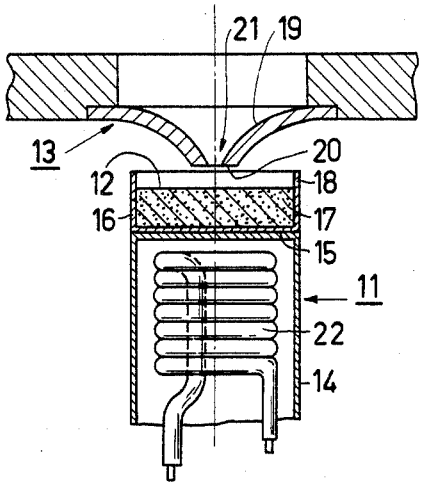
FIG. 2 is an enlarged sectional view of the diode electron gun of the television camera tube shown in FIG. 1.

FIG. 2 is an enlarged sectional view of FIG. 1. The cathode 11 consists of a molybdenum cathode shaft 14 having a wall thickness of approximately 40 μum. An insulated cathode filament 22 is provided in cathode shaft 14. A cup-shaped holder 16 manufactured from 30 μum thick metal foil is connected to the approximately 100 μum thick end face 15 of the cathode shaft 14 by means of resistance welds. A tungsten body 17, impregnated with barium aluminate is arranged in holder 16. Surface 12 of tungsten body 17 forms the emissive surface of the cathode.

An end portion of the cup-shaped holder 16 also forms a collar 18. Collar 18 projects beyond the emissive surface 12 in the direction of the anode 13. The inside diameter of the holder 16 is approximately 900 μum. The height of the collar measured from the emissive surface is approximately 150 μum.

The anode 13 has an approximately 300 μum high funnel-shaped part 19. Funnel-shaped part 19 has a flat bottom portion 20 having a diameter of approximately 300 μum. Bottom portion 20 has an aperture 21. The aperture 21 is so small, for example 20 μum, that not all of the electron beam will pass through aperture 21. The distance between the bottom portion 20 of anode 13 and the emissive surface 12 of cathode 11 is approximately 230 μm.

In a diode electron gun as shown in FIG. 2 but without the collar 18 on the cathode, a cathode current ($I_k$) of 2.7 mA is necessary to reach a beam current of 200 nA on the target. In a diode electron gun as shown in FIG. 2, i,e. with the collar 18, only 1.7 mA cathode current is necessary to reach a beam current of 200 nA. The diode voltage (the voltage between the anode and the cathode) is in both cases approximately 22 volts. The power saving is therefore approximately 22 mW.

When dynamic beam control is used with a beam current of approximately 600 nA, the cathode currents ($I_k$) are 12 mA and 7 mA, respectively, without and with the collar 18 on the cathode 11. The diode voltage in that case is approximately 50 Volts. The power saving in this case is approximately 250 mW.

In a diode gun having a cathode with a lower collar (for example 40 to 50 μm high), the anode current is also smaller than in a diode gun having a cathode without a collar.

It is also possible to apply the invention to camera tubes equipped with oxide cathodes. In that case the collar may be provided as a separate ring or may form part of the substrate for the oxide layer. The substrate usually consists of cathode nickel.

Of course the invention may also be used in camera tubes with diode electron guns as described in the U.S. Pat. No. 3,831,058 having a flat (not funnel-shaped) anode. However, in a triode electron gun, having a cathode, a negative grid with a small aperture and an anode (as described in the article by P. H. Broerse, et al entitled "An experimental light-weight colour television camera", Philips Technical Review, Volume 29, No. 11, pages 325–335, 1968), such a collar on the cathode is not necessary due to the presence of the negative grid. Since a lens is formed between the cathode and the anode, a crossover is formed. In this crossover very many interactions take place between the electrons of the beam so that the beam current inertia is adversely influenced. Consequently, the invention is restricted to television camera tubes having a diode electron gun.

Figure 3:
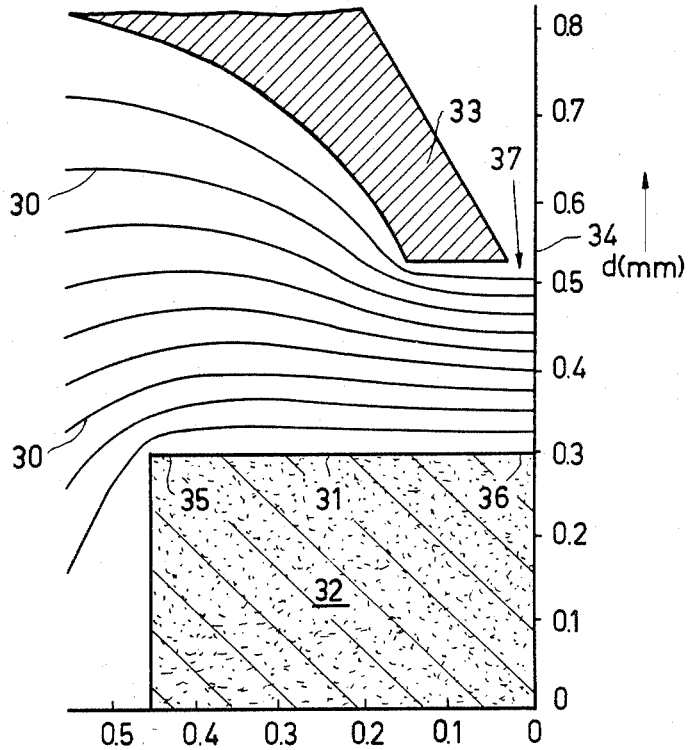
FIG. 3 PRIOR ART
FIG. 3 schematically shows equipotential lines in a diode electron gun having a cathode without a collar.

FIG. 3 schematically shows the equipotential lines 30 between the emissive surface 31 of a cathode 32 and an anode 33 in a prior art diode electron gun. Equipotential lines are the lines of intersection of equipotential surfaces between the cathode and the anode with the plane of the drawing. Because the diode electron gun is rotationally symmetrical, only the pattern of equipotential lines on one side of the tube axis 34 is shown.

From the illustrated variation of the equipotential lines, it follows that the electric field strength near the emissive surface 31 is substantially constant across the surface and even increases at the edge 35. Only the electrons originating from a central portion 36 of the cathode pass through the aperture 37 in the anode 33 so that the electrons not originating from this part of the cathode impinge on the anode. Since the electric field strength increases at the edge 35, the emission also increases. The anode current hence is considerable in such a diode electron gun in spite of the funnel-shaped anode.

Figure 4:
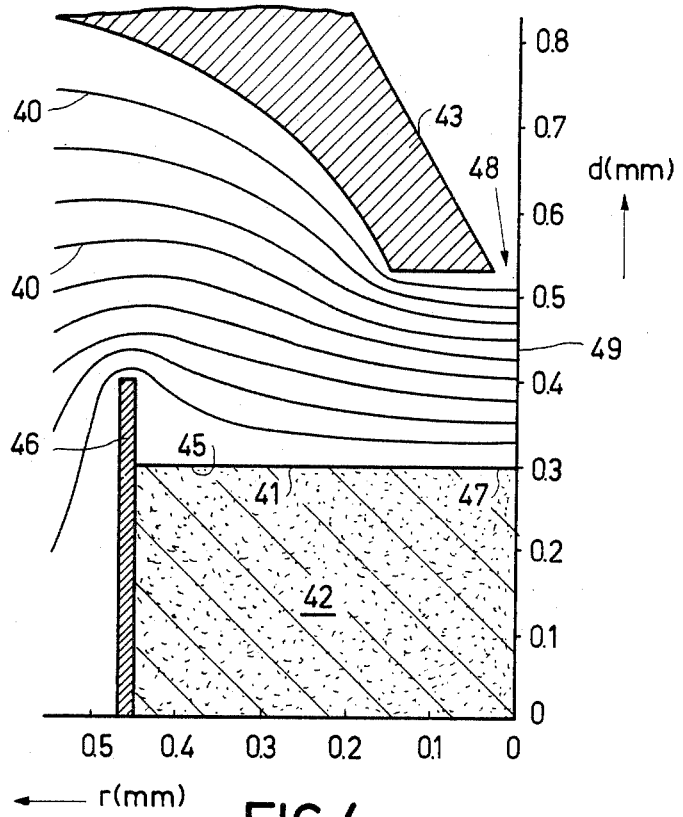
FIG. 4 schematically shows equipotential lines in a diode electrode gun according to the invention.

FIG. 4 schematically shows, analogously to FIG. 3, the equipotential lines 40 between the emissive surface 41 of a cathode 42 and an anode 43 in a diode electron gun according to the invention. The pattern of equipotential lines is again shown only on one side of the tube axis 49 due to the rotational symmetry.

From the illustrated variation of the equipotential lines, it follows that the electric field strength near the emissive surface 41 decreases toward the edge 45. This variation of the equipotential lines and hence of the electric field strength is the result of the collar 46. In this case, collar 46 is 100 μm high and extends in the direction of the anode 43. This decrease in the electric field strength decreases the emission of the cathode proceeding from the center 47 of the emissive surface 41 toward the edge 45 of the emissive surface. As a result, fewer electrons, as compared with the diode electron gun of FIG. 3, impinge on the anode 43. Therefore, the anode current is reduced.

In FIGS. 3 and 4, distances in millimeters are plotted along the axes d and r.

Figure 5:
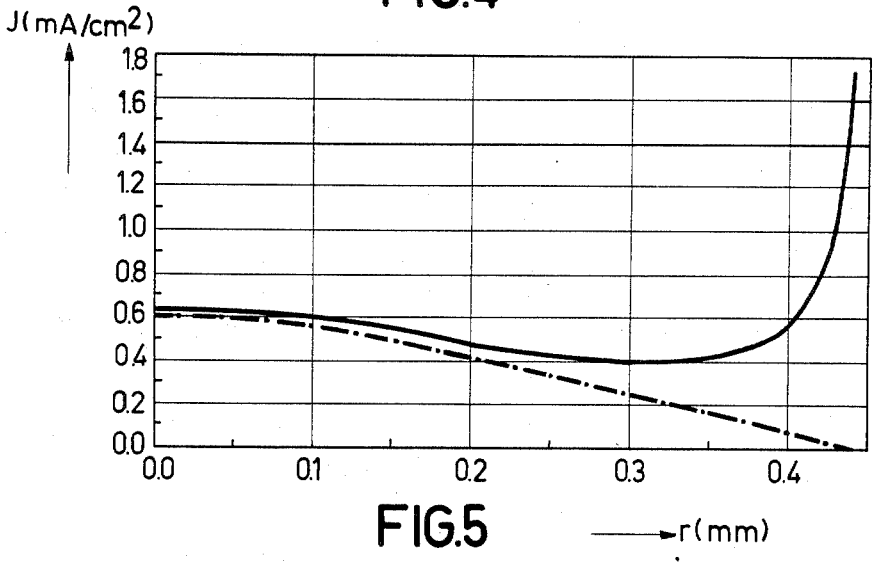
FIG. 5 is a graph of the cathode current density as a function of the distance r from the center of the cathode.

FIG. 5 is a graph of the current density J ($mA/cm^2$) as a function of the distance r from the center of the emissive surface (i) for the FIG. 3 cathode (the solid line), and (ii) for the FIG. 4 cathode (the dot-and-dash line). From FIG. 5 it follows that the emission in the central part of the emissive surface ($r<0.05$ mm) for the two cathodes is approximately equal. However, the emission decreases considerably at the edge ($0.3\ mm<r<0.45$ mm) for the cathode with the collar (the dot-and-dash line), which means that the anode current will be reduced.

The sectional views of FIGS. **6*a* and 6*b* show how a cathode with a collar and with a less porous surface near the collar can be obtained. The manufacture of such a cathode is elaborately described in U.S. Pat. No. 4,215,457 (mentioned above) which is to be considered to be incorporated by reference herein. The method need be modified only by using a larger holder (metal foil 61**).

In the method, a previously manufactured and impregnated porous tungsten body 60 (FIG. **6*a*) is placed on a metal foil 61 of approximately 30 μm thickness. Metal foil 61 is on a die 62 which has an aperture 63 which is adapted to the shape of the porous body. The smallest diameter of the aperture 63 must be slightly smaller than the diameter of the body 60 plus two times the thickness of the foil 61**. This is to give the metal foil not only a deep drawing operation but also to produce a reduction in wall thickness of approximately 5 to 15

μm (so-called tapering). As a result, resistance to deformation is ensured, and the gap between the formed holder 64 (FIG. 6*b*) and the body 60 is smaller than 10 μm (so that evaporation of the emitter is reduced).

Figure 6A:
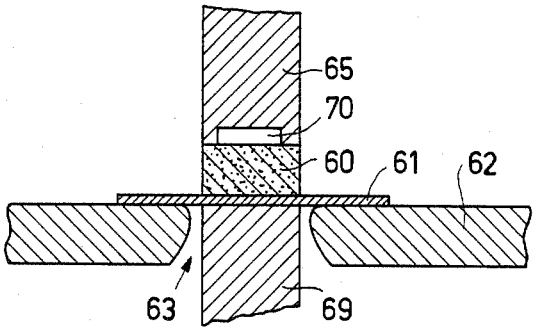
FIGS. 6*a* and 6*b* are cross-sections through a cathode during two stages of manufacture.
Figure 6B:
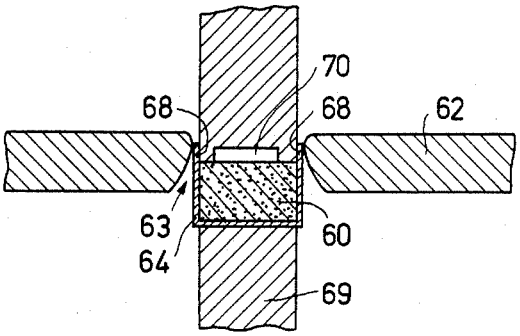

After setup, the body 60 is forced through the aperture 63 by means of the die 65. The body 60 serves as a die for the foil 61 to form holder 64 (FIG. 6*b*). By choosing the diameter of the foil 61 to be larger than in the past, a collar 68 can be formed on the holder 64. A stop member 69 is used for ejecting the holder from the die 62.

By providing the die 65 with a central recess 70 the pores of the porous body at the edges are closed by pressure during the drawing process. As a result, the emission at the edge of tungsten body 60 decreases even further.

What is claimed is:

1. A television camera tube comprising:

an evacuated envelope having an axis and first and second opposite ends;

a photosensitive target at the first end of the envelope;

a cathode arranged toward the second end of the envelope opposite the first end, said cathode having an emissive surface centered on and extending substantially perpendicular to the axis;

an anode arranged between the cathode and the target, said anode having a central aperture around the axis; and a focusing lens arranged between the anode and the target for focusing an electron beam from the cathode and anode onto the target;

characterized in that:

the camera tube further comprises an electrically conductive collar arranged around the emissive surface of the cathode, said collar extending from the emissive surface substantially parallel to the axis at least 40 microns in the direction of the anode; and the emissive surface of the cathode is porous, and the emissive surface has a portion adjacent to the collar which is less porous than a central portion thereof.

2. A television camera tube as claimed in claim 1, characterized in that the collar is a cylinder.

3. A television camera tube as claimed in claim 2, characterized in that the collar is a circular cylinder.

4. A television camera tube as claimed in claim 1, characterized in that the collar extends 100 microns.

5. A television camera tube as claimed in claim 1, characterized in that the collar extends 150 microns.

6. A television camera tube as claimed in claim 1, characterized in that:

the cathode is a dispenser cathode with a holder which envelops a porous emissive body; and the collar is integral with the holder.

7. A television camera tube as claimed in claim 10, characterized in that the pores in the portion of the emissive surface adjacent to the collar are sealed by a high energy beam.

8. A diode electron gun comprising:

a cathode arranged on an axis, said cathode having an emissive surface centered on and extending substantially perpendicular to the axis; and an anode arranged on the axis spaced from the cathode, said anode having a central aperture around the axis;

characterized in that:

the electron gun further comprises an electrically conductive collar arranged around the emissive surface of the cathode, said collar extending from the emissive surface substantially parallel to the axis at least 40 microns in the direction of the anode; and the emissive surface of the cathode is porous, and the emissive surface has a portion adjacent to the collar which is less porous than a central portion thereof.

9. A diode electron gun as claimed in claim 8, characterized in that the collar extends 100 microns.

10. A diode electron gun as claimed in claim 8, characterized in that the collar extends 150 microns.

11. An electron gun comprising:

a cathode arranged on an axis, said cathode having an emissive surface centered on and extending substantially perpendicular to the axis; and an anode arranged on the axis spaced from the cathode, said anode having a central aperture around the axis;

characterized in that:

the electron gun further comprises an electrically conductive collar arranged around the emissive surface of the cathode, said collar extending from the emissive surface substantially parallel to the axis in the direction of the anode; and the emissive surface of the cathode is porous, and the emissive surface has a portion adjacent to the collar which is less porous than a central portion thereof.

* * * * *